US006477496B1

(12) United States Patent
Case

(10) Patent No.: US 6,477,496 B1
(45) **Date of Patent: *Nov. 5, 2002**

(54) SIGNAL SYNTHESIS BY DECODING SUBBAND SCALE FACTORS FROM ONE AUDIO SIGNAL AND SUBBAND SAMPLES FROM DIFFERENT ONE

(76) Inventor: Eliot M. Case, 2876 S. Joslin Ct., Denver, CO (US) 80227

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 48 days.

(21) Appl. No.: 08/772,591

(22) Filed: Dec. 20, 1996

(51) Int. Cl.[7] ..... G10L 13/04; G10L 19/02
(52) U.S. Cl. ..... 704/272; 704/209; 704/261
(58) Field of Search ..... 704/208, 278, 704/233, 500, 501, 503, 504, 209, 261, 272; 381/62, 119, 118

(56) References Cited

U.S. PATENT DOCUMENTS

| | | | | |
|---|---|---|---|---|
| 4,969,192 A | | 11/1990 | Chen et al. | |
| 5,040,217 A | | 8/1991 | Brandenburg et al. | |
| 5,140,638 A | | 8/1992 | Moulsley et al. | |
| 5,157,215 A | * | 10/1992 | Nakae et al. | 84/624 |
| 5,199,076 A | | 3/1993 | Taniguchi et al. | |
| 5,201,006 A | | 4/1993 | Weinrich | |
| 5,226,085 A | | 7/1993 | Di Francesco | |
| 5,227,788 A | | 7/1993 | Johnston et al. | |
| 5,233,660 A | | 8/1993 | Chen | |
| 5,235,669 A | | 8/1993 | Ordentlich et al. | |
| 5,255,343 A | | 10/1993 | Su | |
| 5,285,498 A | | 2/1994 | Johnston | |
| 5,293,449 A | | 3/1994 | Tzeng | |
| 5,293,633 A | | 3/1994 | Robbins | |
| 5,301,019 A | | 4/1994 | Citta | |
| 5,301,205 A | | 4/1994 | Tsutsui et al. | |
| 5,327,521 A | * | 7/1994 | Savic et al. | 704/272 |
| 5,329,613 A | | 7/1994 | Brase et al. | |
| 5,341,457 A | | 8/1994 | Hall, II et al. | |
| 5,353,375 A | | 10/1994 | Goto et al. | |
| 5,404,377 A | | 4/1995 | Moses | |
| 5,467,139 A | | 11/1995 | Lankford | |

(List continued on next page.)

FOREIGN PATENT DOCUMENTS

| | | |
|---|---|---|
| EP | 0446037 A2 | 9/1991 |
| EP | 0446037 A3 | 9/1991 |
| EP | 0607989 A2 | 7/1994 |
| EP | 0607989 A3 | 7/1994 |
| WO | WO94/25959 | 11/1994 |

OTHER PUBLICATIONS

Brandenburg, ISO–MPEG–1 Audio: A generic Standard for Coding of High–Quality Digital Audio, 92nd Conv. Audio Engineering Society, Jul. 15, 1994.*

Kuhn A real–time pitch recognition algorithm for music applications'Computer Music Journal, pp. 60–71, Fall 90.*

*Primary Examiner*—Tālivaldis Ivars Sm̄its
(74) *Attorney, Agent, or Firm*—Townsend and Townsend and Crew LLP

(57) ABSTRACT

A method, system and product are provided for synthesizing sound using encoded audio signals having a plurality of frequency subbands, each subband having a scale factor and sample data associated therewith. The method includes selecting a spectral envelope, and selecting a plurality of frequency subbands, each subband having sample data associated therewith. The method also includes generating a synthetic encoded audio signal having a plurality of frequency subbands, the subbands having the selected spectral envelope and the selected sample data. The system includes control logic for performing the method. The product includes a storage medium having computer readable programmed instructions for performing the method.

9 Claims, 4 Drawing Sheets

U.S. PATENT DOCUMENTS 5,473,631 A 12/1995 Moses
5,488,665 A 1/1996 Johnston et al.
5,500,673 A 3/1996 Zhou
5,509,017 A 4/1996 Brandenburg et al.
5,511,093 A 4/1996 Edler et al.
5,512,939 A 4/1996 Zhou
5,515,395 A 5/1996 Tsutsui
5,633,981 A 5/1997 Davis

* cited by examiner

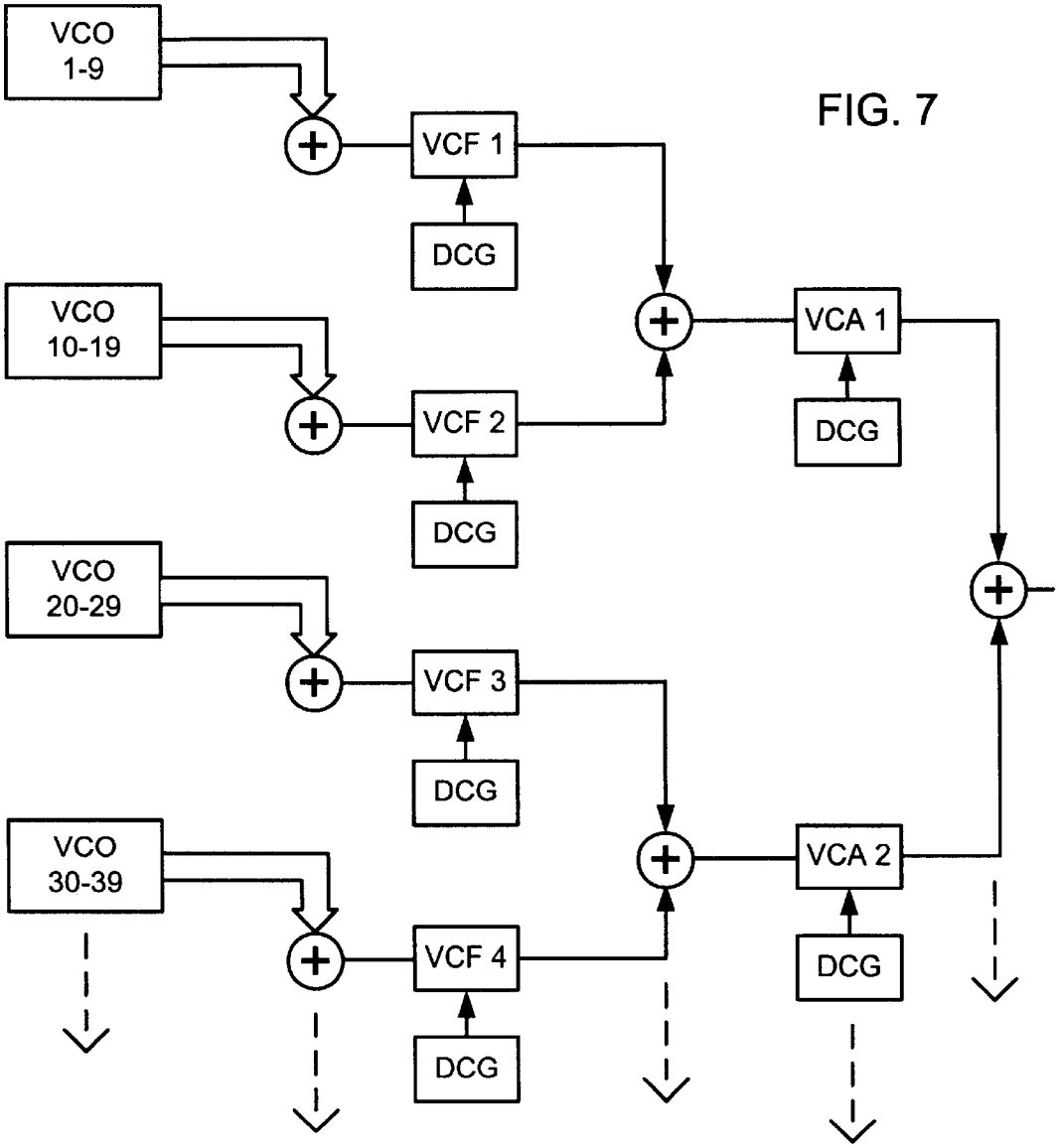
FIG. 7
FIG. 8
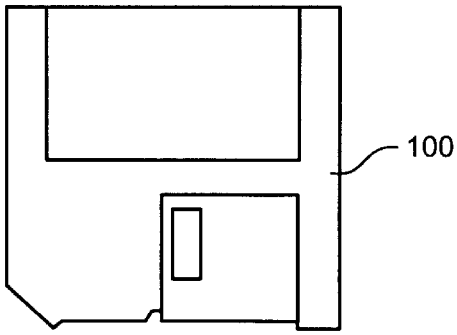

SIGNAL SYNTHESIS BY DECODING SUBBAND SCALE FACTORS FROM ONE AUDIO SIGNAL AND SUBBAND SAMPLES FROM DIFFERENT ONE

CROSS REFERENCE TO RELATED APPLICATIONS

This application is related to U.S. patent application Ser. No. 08/771,790 entitled "Method, System And Product For Lossless Encoding Of Digital Audio Data"; U.S. Ser. No. 08/771,462 entitled "Method, System And Product For Modifying The Dynamic Range Of Encoded Audio Signals"; U.S. Ser. No. 08/771,792 entitled "Method, System And Product For Modifying Transmission And Playback Of Encoded Audio Data"; U.S. Ser. No. 08/771,512 entitled "Method, System And Product For Harmonic Enhancement Of Encoded Audio Signals"; U.S. Ser. No. 08/769,911 entitled "Method, System And Product For Multiband Compression Of Encoded Audio Signals"; U.S. Ser. No. 08/777,724 entitled "Method, System And Product For Mixing Of Encoded Audio Signals"; U.S. Ser. No. 08/769,732 entitled "Method, System And Product For Using Encoded Audio Signals In A Speech Recognition System"; U.S. Ser. No. 08/769,731 entitled "Method, System And Product For Concatenation Of Sound And Voice Files Using Encoded Audio Data"; and U.S. Ser. No. 08/771,469 entitled "Graphic Interface System And Product For Editing Encoded Audio Data", all of which were filed on the same date and assigned to the same assignee as the present application.

TECHNICAL FIELD

This invention relates to a method, system and product for synthesizing sound using encoded audio signals.

BACKGROUND ART

To more efficiently transmit digital audio data on low bandwidth data networks, or to store larger amounts of digital audio data in a small data space, various data compression or encoding systems and techniques have been developed. Many such encoded audio systems use as a main element in data reduction the concept of not transmitting, or otherwise not storing portions of the audio that might not be perceived by an end user. As a result, such systems are referred to as perceptually encoded or "lossy" audio systems.

However, as a result of such data elimination, perceptually encoded audio systems are not considered "audiophile" quality, and suffer from processing limitations. To overcome such deficiencies, a method, system and product have been developed to encode digital audio signals in a loss-less fashion, which is more properly referred to as "component audio" rather than perceptual encoding, since all portions or components of the digital audio signal are retained. Such a method, system and product are described in detail in U.S. patent application Ser. No. 08/771,790 entitled "Method, system and product For Lossless Encoding Of Digital Audio Data", which was filed on the same date and assigned to the same assignee as the present application, and is hereby incorporated by reference.

However, due to the quantity of calculations associated with synthesizing high quality sounds such as voice or music, such synthesis is typically performed using dedicated linear audio (e.g., LPC) digital signal processors (DSP), analog systems, hybrids, or other systems. For example, a DSP linear digital audio equivalent of an analog music synthesizer with two oscillators, a voltage-controlled filter and a voltage-controlled amplifier requires four powerful signal processing algorithms for each musical "note." Moreover, algorithms such as dynamic cutoff frequency digital filters are at this point considered inferior to analog.

Thus, there exists a need for a method, system and product for synthesizing sound using encoded audio signals, particularly perceptually encoded audio signals. Such a method, system and product would permit any form of sound, voice or music synthesizer to be easily generated with much less effort than deployment in any other form of medium, such as linear digital audio, analog systems, hybrids, or others. Such a method, system and product could also provide for sound synthesis with less delay than associated with a perceptual audio encoder and decoder loop.

SUMMARY OF THE INVENTION

Accordingly, it is the principle object of the present invention to provide a method, system and product for synthesizing sound using encoded audio signals, particularly perceptually encoded and component audio signals.

According to the present invention, then, a method is provided for synthesizing sound using encoded audio signals. The method comprises selecting a spectral envelope, and selecting a plurality of frequency subbands, each subband having sample data associated therewith. The method further comprises generating a synthetic encoded audio signal having a plurality of frequency subbands, the subbands having the selected spectral envelope and the selected sample data.

A system for synthesizing sound using encoded audio signals is also provided. The system comprises a controller for selecting a spectral envelope and a plurality of frequency subbands, each subband having sample data associated therewith. The system further comprises control logic operative to generate a synthetic encoded audio signal having a plurality of frequency subbands, the subbands having the selected spectral envelope and the selected sample data.

A product for synthesizing sound using encoded audio signals is also provided. The product comprises a storage medium having computer readable programmed instructions recorded thereon. The instructions are operative to generate a synthetic encoded audio signal having a plurality of frequency subbands, the subbands having a selected spectral envelope and selected sample data.

These and other objects, features and advantages will be readily apparent upon consideration of the following detailed description in conjunction with the accompanying drawings.

BRIEF DESCRIPTION OF THE DRAWINGS

FIG. 7 is an exemplary DSP sound synthesizer according to the present invention; and FIG. 8 is an exemplary storage medium for use with the product of the present invention.

BEST MODE FOR CARRYING OUT THE INVENTION

In general, the present invention is designed for synthesizing sound using subband coded audio signals, particularly perceptually encoded audio data, to synthesize sounds such as human speech, musical instruments and the like, by either direct synthesis and/or playback of recordings both natural and modified. The present invention synthesizes sound by generating or manipulating perceptually encoded data, using the decoders of this audio data at the listener position to perform the final translation into audible sound.

Figure 1:
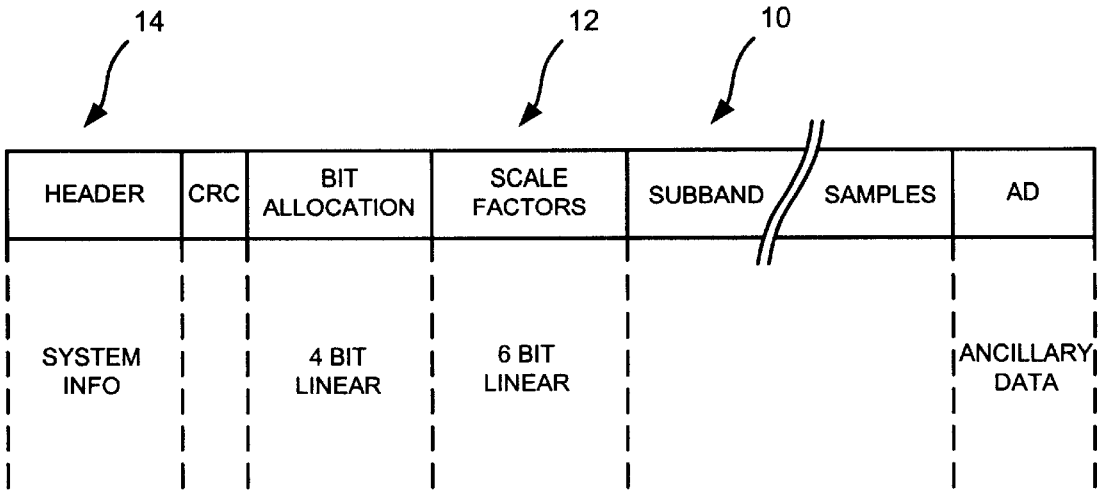
FIG. 1 is an exemplary encoding format for an audio frame according to prior art perceptually encoded audio systems.

Referring now to FIGS. 1–8, the preferred embodiment of the present invention will now be described. FIG. 1 depicts an exemplary encoding format for an audio frame according to prior art perceptually encoded audio systems, such as the various layers of the Motion Pictures Expert Group (MPEG), Musicam, or others. Examples of such systems are described in detail in a paper by K. Brandenburg et al. entitled "ISO-MPEG-1 Audio: A Generic Standard For Coding High-Quality Digital Audio", Audio Engineering Society, 92nd Convention, Vienna, Austria, March 1992, which is hereby incorporated by reference.

In that regard, it should be noted that the present invention can be applied to subband data encoded as either time versus amplitude (low bit resolution audio bands as in MPEG audio layers 1 or 2, and Musicam) or as frequency elements representing frequency, phase and amplitude data (resulting from Fourier transforms or inverse modified discrete cosine spectral analysis as in MPEG audio layer 3, Dolby AC3 and similar means of spectral analysis). It should further be noted that the present invention is suitable for use with any system using mono, stereo or multichannel sound including Dolby AC3, 5.1 and 7.1 channel systems.

As seen in FIG. 1, such perceptually encoded digital audio includes multiple frequency subband data samples (10), as well as 6 bit dynamic scale factors (12) (per subband) representing an available dynamic range of approximately 120 decibels (dB) given a resolution of 2 dB per scale factor. The bandwidth of each subband is ⅓ octave. Such perceptually encoded digital audio still further includes a header (14) having information pertaining to sync words and other system information such as data formats, audio frame sample rate, channels, etc.

To greatly increase the available dynamic range and/or the resolution thereof, one or more bits may be added to the dynamic scale factors (12). For example, by using 8 bit dynamic scale factors, the dynamic range is doubled to 256 dB and given an improved 1 dB per scale factor resolution. Alternatively, such 8 bit dynamic scale factors, with a given resolution of 0.5 dB per scale factor, will provide a dynamic range of 128 dB. In either case, the accuracy of storage is increased or maintained well beyond what is needed for dynamic range, while the side-effects of low resolution dynamic scaling are reduced.

Figure 2:
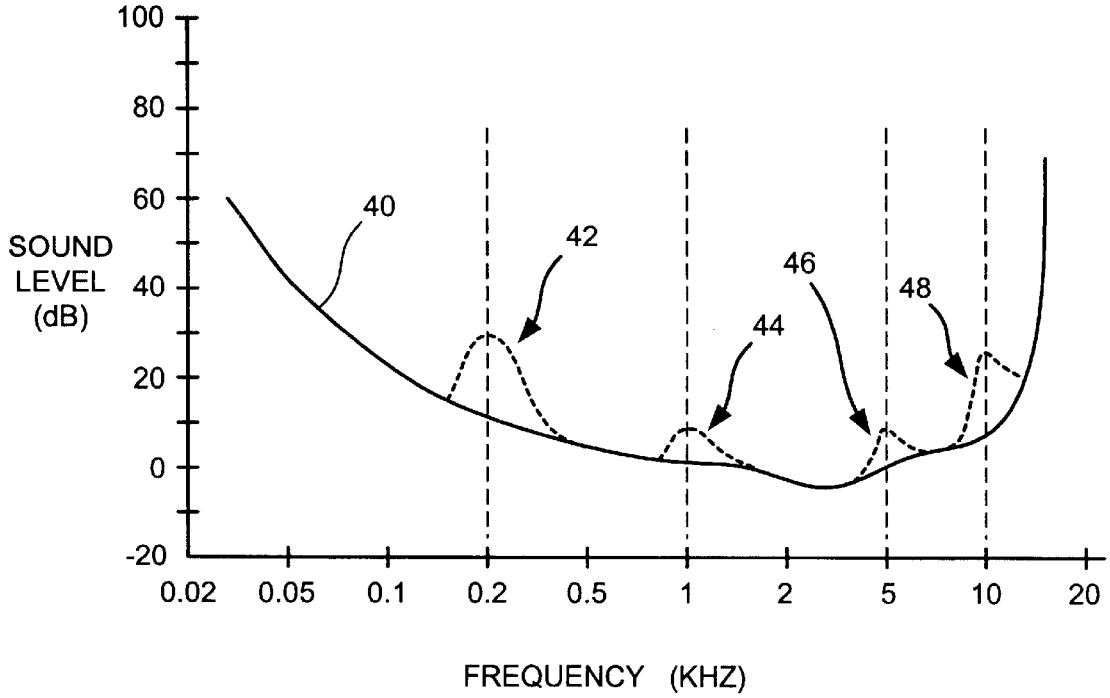
FIG. 2 is a psychoacoustic model of a human ear including exemplary masking effects for use with the present invention.

As previously discussed, perceptually encoded audio systems eliminate portions of the audio that might not be perceived by an end user. This is accomplished using well known psychoacoustic modeling of the human ear. Referring now to FIG. 2, such a psychoacoustic model including exemplary masking effects is shown. As seen therein, at a given frequency (in kHz), sound levels (in dB) below the base line curve (40) are inaudible. Using this information, prior art perceptually encoded audio systems eliminate data samples in those frequency subbands where the sound level is likely inaudible.

As also seen therein, short band noise centered at various frequencies (42, 44, 46, 48) modifies the base line curve (40) to create what are known as masking effects. That is, such noise (42, 44, 46, 48) raises the level of sound required around such frequencies before that sound will be audible to the human ear. Using this information, prior art perceptually encoded audio systems further eliminate data samples in those frequency subbands where the sound level is likely inaudible due to such masking effects.

Alternatively, using a loss-less component audio encoding scheme, such masked audio may be retained. Once again, such a loss-less component audio encoding scheme is described in detail in U.S. patent application Ser. No. 08/771,790 entitled "Method, System And Product For Lossless Encoding Of Digital Audio Data", which was filed on the same date and assigned to the same assignee as the present application, and has been incorporated herein by reference.

In either case, if no information is present to be encoded into a subband, the subband does not need to be transmitted. Moreover, if the subband data is well below the level of audibility (not including masking effects), as shown by base line curve (40) of FIG. 2, the particular subband need not be encoded.

Figure 3A:
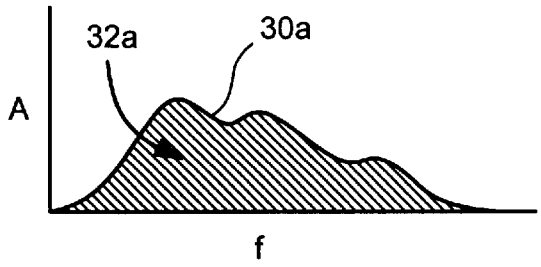
FIGS. 3*a*, 3*b* and 3*c* are graphic representations of original encoded audio data and exemplary synthesized encoded audio data provided according to the present invention.
Figure 3B:
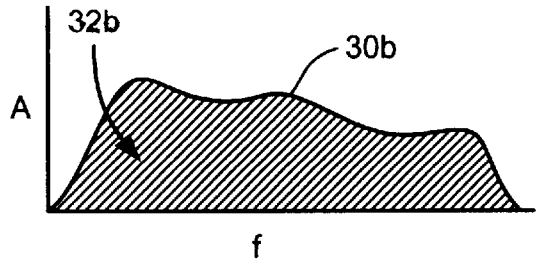
Figure 3C:
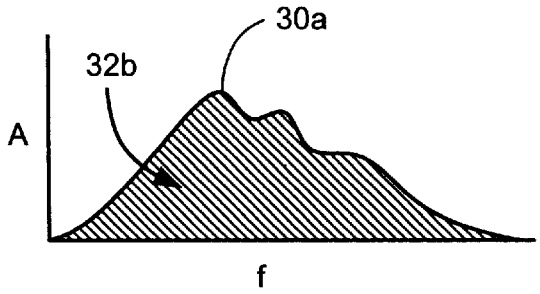

Referring now to FIGS. 3*a*, 3*b* and 3*c*, graphic representations of original encoded audio data and exemplary synthesized encoded audio data provided according to the present invention are shown. In that regard, FIG. 3*a* depicts a spectral graph of frequency versus amplitude for an audio signal encoded according to a 32 subband perceptual encoding audio system, such as MPEG layer 1. Similarly, FIG. 3*b* depicts a spectral graph of frequency versus amplitude for an audio signal encoded according to the same system.

As seen therein, each signal defines a spectral envelope (30*a*, 30*b*) and includes audio subband sample data information (32*a*, 32*b*). Because the data set in perceptually encoded audio data (e.g., MPEG layers 1, 2 or 3) is a well scaled parametric representation of audio signals, direct synthesis of sound by means of generating and/or manipulating data at the encoded level makes very efficient the calculations needed to produce very natural sounding synthetic speech, synthetic musical instruments, entirely new sounds, natural sounding speech, or pitch changes to stored or passing audio data. Moreover, control of the metamorphosis between sound types (e.g. vowel sounds transitioning to fricative sounds) is very easily accomplished.

In that regard, perceptually encoded data is easy to scale. All present audio data is represented in the same manner, independent of the amplitude of the sound, thereby making computation of synthesis factors extremely efficient. Decoders of perceptually encoded audio perform a certain amount of data smoothing that is extremely forgiving of sudden changes in the data being decoded. The perceptual audio decoders (e.g., MPEG layers 1, 2 or 3) effectively smooth the output audio being decoded from each subband of audio data (antialiasing); providing elimination of any inadvertent sounds being generated that would be outside of the subband channel. In other words, an abrupt change in a subband signal that would generate high harmonics of distortion in a wideband system would only produce the desired result with all harmonics of distortion removed by means of the standard implementation of perceptual audio decoders.

Thus, mapping of the spectral envelope of one signal onto the harmonic content of another signal is easily accomplished in the perceptually encoded data environment, as shown in FIG. 3*c*. In such a fashion, the present invention provides such tools as "vocoders" that effectively can take the natural signals and audio subband samples from one signal (32*b*), and allow the different spectral elements to pass through to the decoder in the exact amplitude relationships (30*a*) as a signal from another datastream (or data file).

For example, where the signal of FIG. 3*a* is a voice, and the signal of FIG. 3*b* is an orchestra, the resulting signal of FIG. 3*c* would be a talking orchestra. Alternatively, naturally generated voice recordings can be "mapped" onto natural voice elements that are dynamically contoured for pitch inflections, etc. In such a fashion, the present invention would produce synthetic speech bordering on, if not natural in quality.

Figure 4:
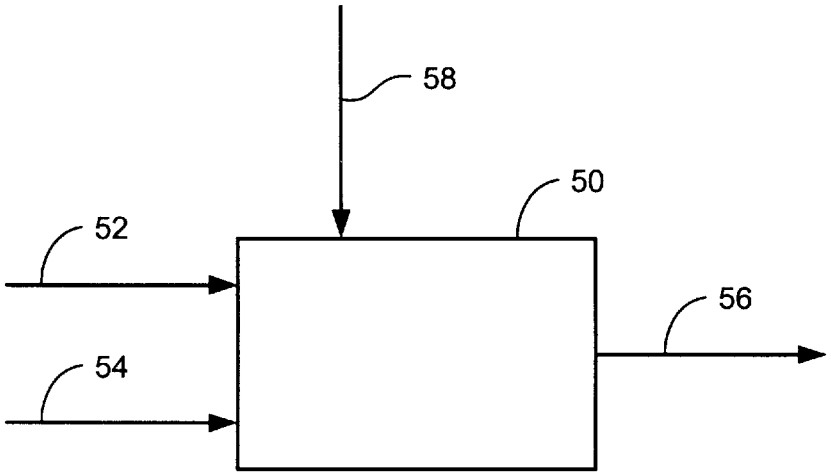
FIG. 4 is a simplified block diagram of the system of the present invention.
Figure 5:
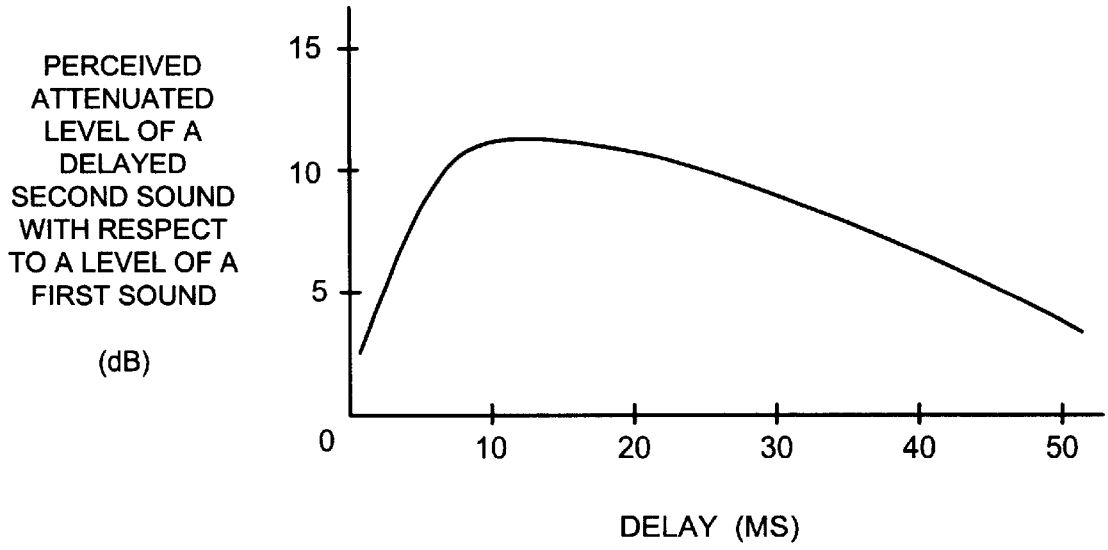
FIG. 5 is a Haas fusion zone effect curve for use with the present invention.

Referring now to FIG. 4, a simplified block diagram of the system of the present invention is shown. As seen therein, the system preferably comprises an appropriately programmed processor (50) for Digital Signal Processing (DSP). Processor (50) acts as a receiver for receiving first and second encoded audio signals (52, 54) (either or both of which may be stored sound files/assets) having a plurality of frequency subbands associated therewith. In that regard, the subbands of the first signal (52) define a spectral envelope, while each of the subbands of the second signal (54) has audio subband sample data associated therewith. While described herein as preferably perceptually encoded, as previously stated, encoded audio signals (52, 54) may also be component audio signals or sound files/assets.

Once programmed, processor (50) provides control logic for performing various functions of the present invention. In that regard, control logic is operative to generate a synthetic encoded audio signal (56) having a plurality of frequency bands, the subbands having the spectral envelope of the first encoded audio signal (53) and the sample data of the second encoded audio signal (54).

Processor (50) also receives control input (58) for determining which of the signals (52, 54) will provide the spectral envelope, and which will provide the audio subband sample data (i.e., which will be designated as first and second signals). In that regard, it should also be noted that the present invention is capable of generating synthetic encoded audio signal (56) without first and second encoded audio signals (52, 54). That is, control input (58) could also include spectral envelope, frequency subband sample data and/or any other appropriate information for generation of a purely synthetic encoded audio signal, rather than a synthetic encoded audio signal that is a modification of existing encoded audio signals. As also previously stated, however, the first and second signals (52, 54) may comprise a naturally generated voice recording and a controlled natural voice sound, respectively.

As also shown in FIG. 4, the control logic of processor (50) may be further operative to perform the well known data formatting and bit allocating functions associated with known perceptually encoded audio systems such as MPEG. In that regard, for such perceptually encoded audio systems, the control logic of processor (50) would also calculate in appropriate masking effects associated with the synthetically generated encoded audio signal, as previously described with reference to FIG. 2. In that same regard, control logic would also calculate temporal masking or pre-echo effects as depicted in the Haas fusion effect zone curve of FIG. 5.

Figure 6:
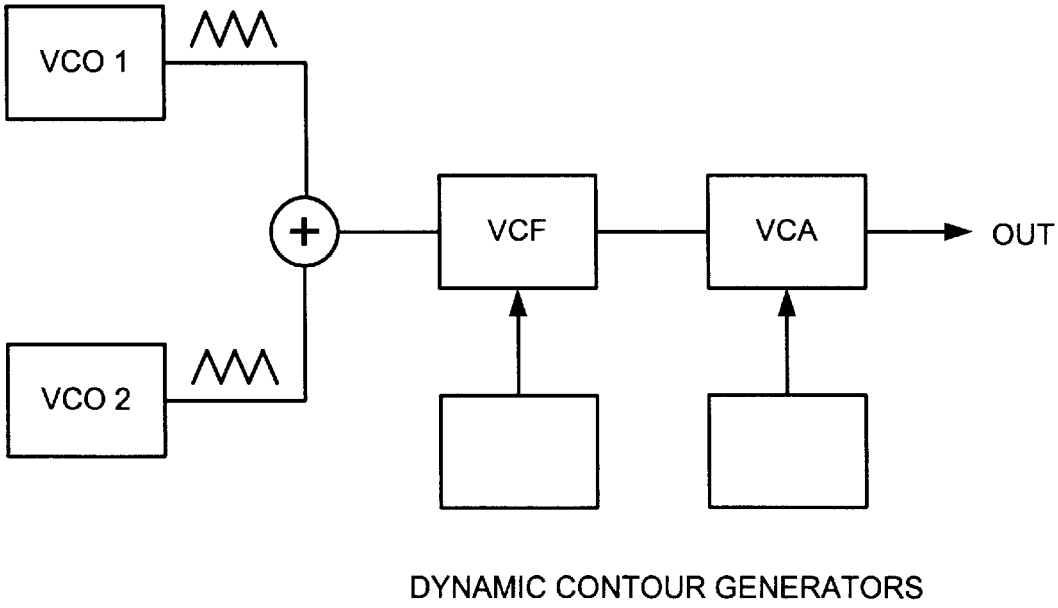
FIG. 6 is an exemplary prior art analog sound synthesizer.

According to the present invention, any form of sound, voice, or music synthesizer could be easily generated with much less effort than deployment in any other form of medium, such as linear digital audio, analog systems, hybrids, or others. For example, according to the present invention, creating an encoded audio equivalent of an analog music synthesizer with two oscillators, a voltage-controlled filter and a voltage-controlled amplifier, as shown in FIG. 6, would be greatly simplified. In that regard, only very simple algorithms would be required to perform the same functions, because the algorithms operate on the parameters and course data of the audio signals, which are relatively small bit words (e.g., 2 bits) transmitted at relatively low data rates (e.g., 56 kbs).

So, with still less processing than the linear digital audio version of the analog synthesizer mentioned above, many more processing components can be added to the perceptually modeled simulation with minimal artifacts, such as 100 voltage-controlled oscillators, ten voltage-controlled filters, five voltage-controlled amplifiers and a mixer for all of these processors, as depicted in FIG. 7. It should be noted here that FIG. 7 is well beyond what might ever be needed, but exemplifies the possibilities/advantages of the present invention due to the simplified/reduced calculations.

Indeed, an infinite variety of synthesizers is possible. In such a fashion, any type of polyphonic sounds could be synthesized, such as thousands of string instruments playing together with all the phase coincidence that would occur. Alternatively, monophonic voice sounds (speech) could also be synthesized that would have a natural quality.

Referring finally to FIG. 8, an exemplary storage medium for the product of the present invention is shown. In that regard, storage medium (100) is depicted as a conventional floppy disk, although any other type of storage medium may also be used.

Storage medium (100) has recorded thereon computer readable programmed instructions for performing various functions of the present invention. More particularly, storage medium (100) includes instructions operative to generate a synthetic encoded audio signal having a plurality of frequency subbands, the subbands having a selected spectral envelope and selected sample data.

In that regard, it should once again be noted that the present invention is capable of generating a synthetic encoded audio signal without existing encoded audio signals. That is, control input could be provided which would include spectral envelope, frequency subband sample data and/or any other appropriate information for generation of a purely synthetic encoded audio signal, rather than a synthetic encoded audio signal that is a modification of existing encoded audio signals. As also previously stated, however, the existing encoded audio signals may be used and may comprise a naturally generated voice recording and a controlled natural voice sound, respectively.

It should be noted that the present invention works on passing data streams, artificially generated internal signals, or fixed recorded assets. In such a fashion, the original program material can remain uncompromised. Moreover, the original material can also be encoded according to widely deployed generic encoding schemes/systems.

In that same regard, it should also be noted that the present invention is suitable for use in any type of DSP application including computer systems, hearing aids, post-production, and transmission across networks including cellular, wireless and cable telephony, internet, cable television, satellites, etc. Indeed, internet applications could use this type of synthesis to improve download times for audio. Insertion of locally synthesized elements could be added to MPEG audio datastreams at the point of delivery for custom voice or sound playback. The present invention could also be used to generate more natural sounding text to speech systems.

It should still further be noted that the present invention can be used in conjunction with the inventions disclosed in U.S. patent application Ser. No. 08/771,790 entitled "Method, System And Product For Lossless Encoding Of Digital Audio Data"; U.S. Ser. No. 08/771,462 entitled "Method, System And Product For Modifying The Dynamic Range Of Encoded Audio Signals"; U.S. Ser. No. 08/771,792 entitled "Method, System And Product For Modifying Transmission And Playback Of Encoded Audio Data"; U.S. Ser. No. 08/771,512 entitled "Method, System And Product For Harmonic Enhancement Of Encoded Audio Signals"; U.S. Ser. No. 08/769,911 entitled "Method, System And Product For Multiband Compression Of Encoded Audio Signals"; U.S. Ser. No. 08/777,724 entitled "Method, System And Product For Mixing Of Encoded Audio Signals"; U.S. Ser. No. 08/769,732 entitled "Method, System And Product For Using Encoded Audio Signals In A Speech Recognition System"; U.S. Ser. No. 08/769,731 entitled "Method, System And Product For Concatenation Of Sound And Voice Files Using Encoded Audio Data"; and U.S. Ser. No. 08/771,469 entitled "Graphic Interface System And Product For Editing Encoded Audio Data", all of which were filed on the same date and assigned to the same assignee as the present application, and which are hereby incorporated by reference.

As is readily apparent from the foregoing description, then, the present invention provides a method, system and product for synthesizing sound using encoded audio signals, particularly perceptually encoded audio signals. More specifically, the present invention permits any form of music synthesizer to be easily generated with much less effort than deployment in any other form of medium, with less delay than associated with a perceptual audio encoder and decoder loop. Still further, the present invention provides a small, accurate and efficient method, system and product allowing a more natural transition between types of sounds used in synthesis, while using very minimal computation for high fidelity results.

It is to be understood that the present invention has been described above in an illustrative manner and that the terminology which has been used is intended to be in the nature of words of description rather than of limitation. As previously stated, many modifications and variations of the present invention are possible in light of the above teachings. Therefore, it is also to be understood that, within the scope of the following claims, the invention may be practiced otherwise than as specifically described herein.

What is claimed is:

1. A method for synthesizing a subband encoded audio signal having a plurality of frequency subbands, each subband having a scale factor and sample data associated therewith, the method comprising:

selecting a first subband encoded audio signal, the first signal having a plurality of frequency subbands, each subband having a scale factor and sample data associated therewith;

selecting a second subband encoded audio signal, the second signal having a plurality of frequency subbands, each subband having a scale factor and sample data associated therewith; and synthesizing an encoded audio signal directly from the first and second subband encoded audio signals, the synthesized encoded audio signal having the scale factors of the first subband encoded audio signal and the sample data of the second subband encoded audio signal.

2. The method of claim 1 wherein the first encoded audio signal comprises a perceptually encoded audio signal.

3. The method of claim 1 wherein the first encoded audio signal comprises a voice recording.

4. A system for synthesizing a subband encoded audio signal having a plurality of frequency subbands, each subband having a scale factor and sample data associated therewith, the system comprising:

a controller for selecting a first subbband encoded audio signal, the first signal having a plurality of frequency subbands, each subband having a scale factor and sample data associated therewith, and a second subband encoded audio signal, the second signal having a plurality of frequency subbands, each subband having a scale factor and sample data associated therewith; and control logic operative to synthesize an encoded audio signal directly from the first and second subband encoded audio signals, the synthesized encoded audio signal having the scale factors of the first subband encoded audio signal and the sample data of the second subband encoded audio signal.

5. The method of claim 4 wherein the first and encoded audio signal comprises a perceptually encoded audio signal.

6. The system of claim 4 wherein the first encoded audio signal comprises a voice recording.

7. A product for synthesizing a subband encoded audio signal having a plurality of frequency subbands, each subband having a scale factor and sample data associated therewith, the product comprising:

a storage medium; and computer readable instructions recorded on the storage medium, the instructions operative to select a first subband encoded audio signal, the first signal having a plurality of frequency subbands, each subband having a scale factor and sample data associated therewith, select a second subband encoded audio signal, the second signal having a plurality of frequency subbands, each subband having a scale factor and sample data associated therewith, and to synthesize an encoded audio signal directly from the first and second subband encoded audio signals, the synthesized encoded audio signal having the scale factors of the first subband encoded audio signal and the sample data of the second subband encoded audio signal.

8. The product of claim 7 wherein the first and second encoded audio signals comprise first and second perceptually encoded audio signals.

9. The product of claim 8 wherein the first perceptually encoded audio signal comprises a voice recording.

* * * * *